US012642409B2

(12) United States Patent
Zhang et al.

(10) Patent No.: US 12,642,409 B2
(45) Date of Patent: Jun. 2, 2026

(54) STAIR CLEANING ROBOT BASED ON RETRACTABLE ROTATING ARMS

(71) Applicant: NANTONG UNIVERSITY, Nantong (CN)

(72) Inventors: Lei Zhang, Nantong (CN); Jiangen Shao, Nantong (CN); Lei Su, Nantong (CN); Haitao Liu, Nantong (CN); Yu Liu, Nantong (CN); Xingtian Yao, Nantong (CN); Lijuan Dai, Nantong (CN)

(73) Assignee: NANTONG UNIVERSITY, Nantong (CN)

( * ) Notice: Subject to any disclaimer, the term of this patent is extended or adjusted under 35 U.S.C. 154(b) by 321 days.

(21) Appl. No.: 18/692,335

(22) PCT Filed: May 18, 2023

(86) PCT No.: PCT/CN2023/094917
§ 371 (c)(1),
(2) Date: Mar. 15, 2024

(87) PCT Pub. No.: WO2023/226857
PCT Pub. Date: Nov. 30, 2023

(65) Prior Publication Data

US 2024/0374101 A1 Nov. 14, 2024

(30) Foreign Application Priority Data

May 26, 2022 (CN) ..... 202210584249.6

(51) Int. Cl.
*A47L 11/24* (2006.01)
*A47L 11/40* (2006.01)

(52) U.S. Cl.
CPC ..... *A47L 11/24* (2013.01); *A47L 11/4011* (2013.01); *A47L 11/4036* (2013.01); *A47L 11/4061* (2013.01); *A47L 2201/00* (2013.01)

(58) Field of Classification Search
CPC .. A47L 11/24; A47L 11/4011; A47L 11/4036; A47L 11/4061; A47L 2200/00; A47L 2200/04
See application file for complete search history.

(56) References Cited

FOREIGN PATENT DOCUMENTS

CN 102631172 A 8/2012
CN 103909992 A 7/2014
(Continued)

OTHER PUBLICATIONS

Hongwei Fan, et al, Structural and Control System Design of Box-type Stair Cleaning Robot, Mechanical Engineering, 2019, pp. 30-33, vol. 57, No. 2.

(Continued)

*Primary Examiner* — Andrew A Horton
(74) *Attorney, Agent, or Firm* — Bayramoglu Law Offices LLC

(57) ABSTRACT

A stair cleaning robot based on retractable rotational arms, including a cleaning robot body, wherein the cleaning robot body includes a machine body, a control system disposed at the top of the machine body, and a cleaning mechanism disposed at the bottom of the machine body; a first retractable rotational arm mechanism is disposed on the left side of the machine body, a second retractable rotational arm mechanism is disposed on the right side of the machine body, and the first retractable rotational arm mechanism and the second retractable rotational arm mechanism are disposed in a bilateral symmetry manner; the control system includes a control plate, a battery and a radar which are disposed on a control seat; a first reset sensor is disposed (Continued)

near the radar, and a second reset sensor is disposed near the control plate.

6 Claims, 8 Drawing Sheets

(56) References Cited

FOREIGN PATENT DOCUMENTS

| | | | |
|---|---|---|---|
| CN | 203920967 | U | 11/2014 |
| CN | 204500544 | U | 7/2015 |
| CN | 104904394 | A | 9/2015 |
| CN | 104982128 | A | 10/2015 |
| CN | 204762085 | U | 11/2015 |
| CN | 204762086 | U | 11/2015 |
| CN | 107600212 | A | 1/2018 |
| CN | 109008828 | A | 12/2018 |
| CN | 110338709 | A | 10/2019 |
| CN | 110338713 | A | 10/2019 |
| CN | 210902827 | U | 7/2020 |
| CN | 114766984 | A | 7/2022 |
| DE | 10203326 | A1 | 8/2003 |
| DE | 102016111826 | A1 | 1/2017 |

OTHER PUBLICATIONS

Takahisa Kakudou, et al., Study on mobile mechanism of a climbing robot for stair cleaning: a translational locomotion mechanism and turning motion, Artif Life Robotics, 2013, pp. 400-404, vol. 17.

Takahisa Kakudou, et al., Study on Mobile Mechanism for a Stair Cleaning Robot—Design of Translational Locomotion Mechanism—, 11th International Conference on Control, Automation and Systems, 2011, pp. 1213-1216.

STAIR CLEANING ROBOT BASED ON RETRACTABLE ROTATING ARMS

CROSS REFERENCE TO RELATED APPLICATIONS

This application is a national stage entry of International Application No. PCT/CN2023/094917, filed on May 18, 2023, which is based upon and claims foreign priority to Chinese Patent Application No. 202210584249.6, filed on May 26, 2022, the entire contents of which are incorporated herein by reference.

TECHNICAL FIELD

The present invention relates to the technical field of stair cleaning robots, in particular to a stair cleaning robot based on retractable rotational arms.

BACKGROUND

In a world where the population is rapidly increasing, the construction industry is flourishing, and various high-rise buildings are springing up, the workload for cleaning stairs is huge. However, most of the cleaning robots currently marketed are indoor flat surface cleaning robots, and are ineffective when it comes to stairs or stepped surfaces. In order to solve the automation of related cleaning problems, stair cleaning robots have been continuously developed at home and abroad. Some present stair climbing structures are only applicable to a fixed stair tread height, and cannot climb stairs of different heights.

Fan Hongwei designed a structure and a control system of a box-type stair cleaning robot for climbing based on the lifting and retractable principle. This stair cleaning robot goes upstairs and downstairs with the mode of guide rails cooperating with gears and racks, a mass center adjustment mechanism is provided simultaneously, and a steering engine vertically arranged and a motor support with wheels are connected, allowing the wheels to turn in situ. However, since the robot has a larger volume and bulky structure, making it inconvenient to move back and forth on the steps of the stairs, it has not been able to enter the market.

Takahisa Kakudou and others designed a box-type stair cleaning robot with supporting legs. The robot has the following advantages: The mechanical structure is relatively simple and allows for the convenient arrangement of cleaning modules. When on flat ground, the supporting legs can be retracted to keep close to the machine body, so that the overall size is reduced. However, the use of a flip-type mechanism for descending stairs results in poor stability and increased control difficulty. Therefore, the above-mentioned common problem of walking on stairs of different heights remains unsolved.

Therefore, the present invention provides a stair cleaning robot based on retractable rotational arms, which is expected to solve the problem that the stair cleaning robot walks on stairs of different heights. This is of important significance and value for bringing the stair cleaning robot to practicality.

SUMMARY

The present invention aims to solve the defects existing in the prior art, and proposes a stair cleaning robot based on retractable rotational arms. By adopting the retractable rotational arms, the robot can move on stairs of different heights, thereby improving the range of stairs that can be cleaned by the robot. As the robot goes downstairs without turning its body, the go-downstairs time of the robot is greatly saved, thereby improving the cleaning efficiency, and improving the practical application value of the robot.

In order to achieve the above objective, the present invention adopts the following technical solutions:

A stair cleaning robot based on retractable rotational arms includes a cleaning robot body, and the cleaning robot body includes a machine body, a control system disposed at a top of the machine body and a cleaning mechanism disposed at a bottom of the machine body; a first retractable rotational arm mechanism is disposed on a left side of the machine body, a second retractable rotational arm mechanism is disposed on a right side of the machine body, and the first retractable rotational arm mechanism and the second retractable rotational arm mechanism are disposed in a bilateral symmetry manner;

the control system includes a control plate, a battery and a radar which are disposed on a control seat; a first reset sensor is disposed near the radar, a second reset sensor is disposed near the control plate, and the second reset sensor and the first reset sensor are disposed in a bilateral symmetry manner; the control seat is further provided with a first photoelectric sensor and a second photoelectric sensor, and the first photoelectric sensor and the second photoelectric sensor are disposed on the front side of the bottom plate of the machine body.

Preferably, the machine body includes a housing and a bottom plate disposed at a bottom of the housing; the bottom plate is provided with a first main driving wheel, a second main driving wheel, a third main driving wheel, a fourth main driving wheel, a first omni-directional wheel and a second omni-directional wheel; the first main driving wheel, the third main driving wheel and the first omni-directional wheel are distributed on a left side part of the machine body, and the second main driving wheel, the fourth main driving wheel and the second omni-directional wheel are distributed on a right side part of the machine body;

a rotating main shaft which is transversely arranged is disposed on an inner part of the machine body, a rotational arm motor and a speed reducer are disposed in a middle of the rotating main shaft, a first shaft end support and a first bearing are disposed at one end of the rotating main shaft, and a second shaft end support and a second bearing are disposed at the other end of the rotating main shaft; the rotating main shaft is perpendicular to axial directions of the first main driving wheel, the second main driving wheel, the third main driving wheel and the fourth main driving wheel; the first shaft end support and the second shaft end support are both fixedly connected to the bottom plate, the first shaft end support is connected through the first bearing to allow relative rotation, and the second shaft end fixing seat is connected through the second bearing to allow-relative rotation;

the housing is provided with a housing baffle, an inner side of the housing baffle is provided with a first roller and a second roller, and the first roller and the second roller are connected through a connecting piece to allow rotation.

Preferably, the cleaning mechanism includes a first rotating brush, a second rotating brush, a third rotating brush and a fourth rotating brush which are driven by a motor, and a first rolling brush and a second rolling brush which are driven by a motor; the first rotating brush and the third rotating brush are distributed on the left side of the machine body and perform symmetric rotation movement, the second rotating brush and the fourth rotating brush are distributed on the right side of the machine body and perform symmetric rotation movement, and the first rolling brush and the second rolling brush are distributed in a middle of the machine body and perform symmetric rotation movement; the cleaning mechanism further includes a fan and a dust box which are disposed on an inner side of the machine body; the fan is connected to the dust box, a dust inlet is formed between the first rolling brush and the second rolling brush, and the fan forms negative pressure at the dust inlet to suck garbage into the dust box.

Preferably, the first retractable rotational arm mechanism and the second retractable rotational arm mechanism have the same structure and are both fixedly connected to the rotating main shaft through the two ends of the rotating main shaft; the first retractable rotational arm mechanism includes a driving large arm connected to the rotating main shaft and a driven large arm connected to the driving large arm; a driving pulley, a third bearing and a push rod seat are disposed on an inner side wall of the driving large arm, the first shaft end support and the driving pulley are fixedly connected through a screw, and the driving pulley is connected to the rotating main shaft through the third bearing to allow relative rotation; a driven pulley, a tensioning wheel rotational arm and a push rod part are disposed on an inner side wall of the driven large arm, one end of the push rod part is connected to the driven large arm, and the other end of the push rod part is connected to the push rod seat;

a first tensioning wheel and a second tensioning wheel are disposed on the tensioning wheel rotational arm, and the driving pulley, the first tensioning wheel, the second tensioning wheel and the driven pulley are sleeved with a drive belt.

Preferably, the tensioning wheel rotational arm is fixedly connected to a tensioning wheel rotating shaft, and the tensioning wheel rotating shaft and the driven large arm are connected through the fourth bearing and a torsion spring to allow relative rotation; the driven pulley is connected to a rotating small arm through a rotating shaft, and the rotating small arm is disposed on an outer side of the driven large arm, allowing mutual rotation with the driven large arm.

Preferably, the first main driving wheel, the second main driving wheel, the third main driving wheel and the fourth main driving wheel are all Mecanum wheels.

Compared with the prior art, the present invention has the following beneficial effects:

1. The present invention adopts the retractable rotational arms, and the main driving wheel and the rotating main shaft for driving the rotational arms are consistent in direction (namely the driving wheel shaft is perpendicular to the rotating main shaft), so that the robot can directly go downstairs at the edge of the stairs by rotating the rotational arms without turning its body. The mode greatly saves the time for the robot to go downstairs (because the robot does not need to turning its body), the robot can move on the stairs of different heights, and the range of the stairs which can be cleaned by the robot is improved, thereby laying a good foundation for the popularization and application of the robot.
2. To avoid the unreliable traditional distance measurement by depending on sensors on the side surface, the present invention adopts a design with rear-mounted rollers to ensure that the robot moves back and forth along the tread surface against the stair riser.
3. The present invention detects whether the advancing direction is obstructed or not through the radar, so that the robot can deal with various actual conditions, and the practical application value of the robot is improved.

In the figures: 1 Control system, 2 Cleaning mechanism, 3 First retractable rotational arm mechanism, 4 Second retractable rotational arm mechanism, 5 Machine body, 6 Control plate, 7 Battery, 8 First reset sensor, 9 Second reset sensor, 10 First photoelectric sensor, 11 Second photoelectric sensor, 12 Radar, 13 First rotating brush, 14 Second rotating brush, 15 Third rotating brush, 16 Fourth rotating brush, 17 First rolling brush, 18 Second rolling brush, 19 Fan, 20 Dust box, 21 Driving pulley, 22 Third bearing, 23 Driving large arm, 24 Driven large arm, 25 Driven pulley, 26 Drive belt, 27 Push rod seat, 28 Push rod part, 29 First tensioning wheel, 30 Tensioning wheel rotational arm, 31 Second tensioning wheel, 32 Rotating shaft, 33 Rotating small arm, 34 Torsion spring, 35 Tensioning wheel rotating shaft, 36 Bottom plate, 37 First main driving wheel, 38 Second main driving wheel, 39 First omni-directional wheel, 40 Third main driving wheel, 41 Fourth main driving wheel, 42 Second omni-directional wheel, 43 First shaft end fixing seat, 44 First bearing, 45 Rotating main shaft, 46 Rotational arm motor, 47 Speed reducer, 48 Second shaft end fixing seat, 49 Second bearing, 50 Housing, 51 Housing baffle, 52 First roller, 53 Second roller, and 54 Dust inlet.

DETAILED DESCRIPTION OF THE EMBODIMENTS

The technical solutions in the embodiments of the present invention will be clearly and completely described below with reference to the accompanying drawings, so that those skilled in the art can better understand the advantages and features of the present invention, and thus the scope of the present invention is more clearly defined. The embodiments described herein are only a few embodiments of the present invention, rather than all embodiments, and all other embodiments that can be derived by one of ordinary skill in the art based on the embodiments of the present invention are intended to be within the scope of the present invention.

Figure 1:
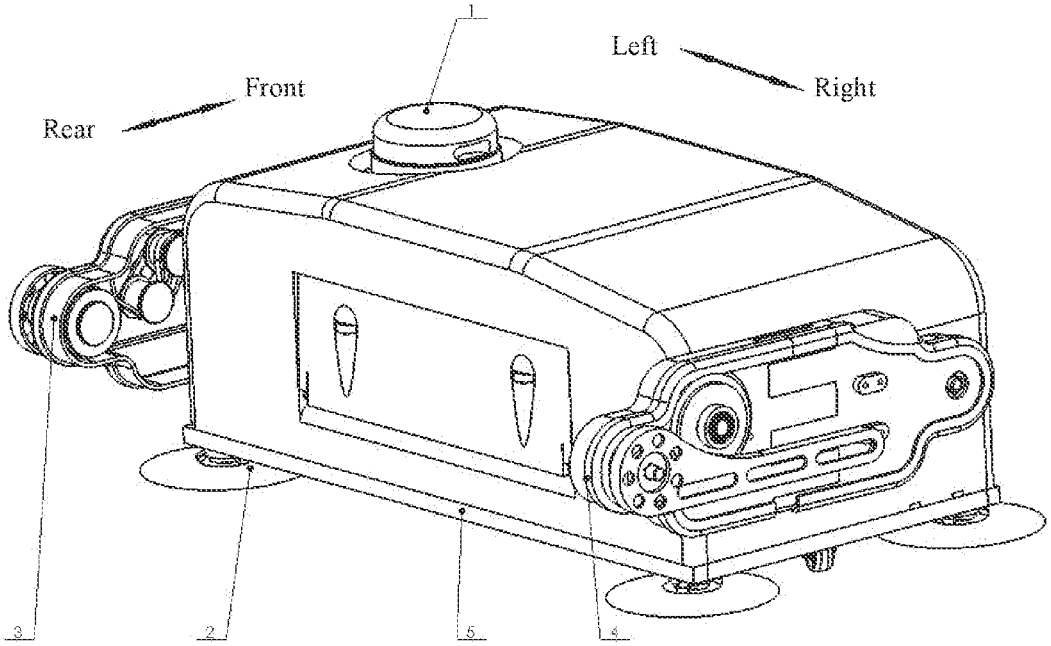
FIG. 1 is a schematic diagram of an overall structure according to the present invention.

It should be noted that, in the embodiment, the orientations of the robot with respect to the front, rear, left, and right are shown in FIG. 1, and the movement of the robot of the present invention on the tread surface means that the robot moves on the tread surface in the left-right direction, i.e. the robot moves sideways like a crab, rather than mainly moving forward.

Referring to FIGS. 1-15, a stair cleaning robot based on retractable rotational arms includes a cleaning robot body. The cleaning robot body includes a machine body 5, a control system 1 disposed at the top of the machine body 5 and a cleaning mechanism 2 disposed at the bottom of the machine body 5. A first retractable rotational arm mechanism 3 is disposed on the left side of the machine body 5, a second retractable rotational arm mechanism 4 is disposed on the right side of the machine body 5, and the first retractable rotational arm mechanism 3 and the second retractable rotational arm mechanism 4 are disposed in a bilateral symmetry manner.

Figure 2:
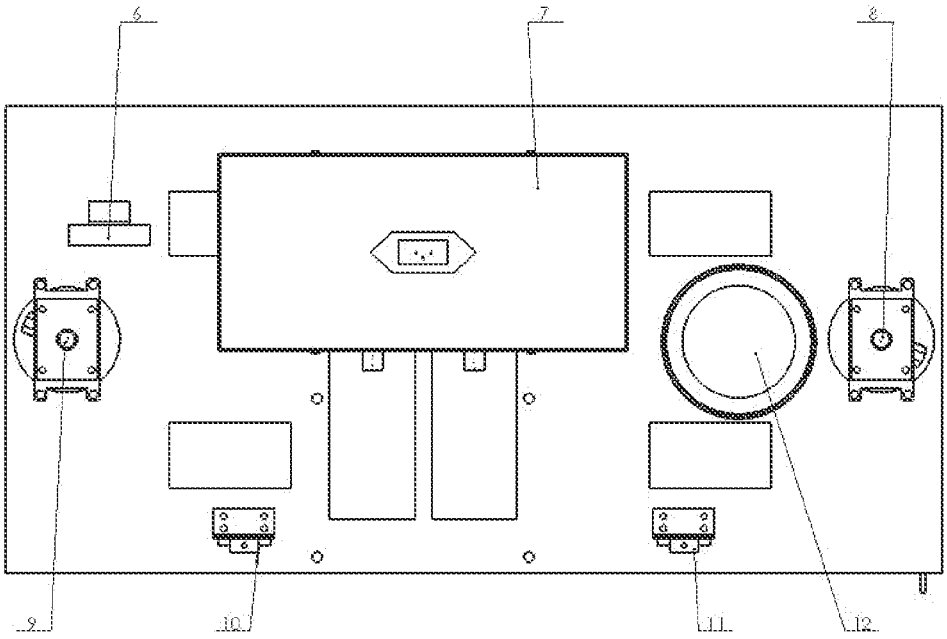
FIG. 2 is a schematic structural diagram of a control system according to the present invention.

Referring to FIG. 2, the control system 1 includes a control plate 6, a battery 7 and a radar 12 which are disposed on a control seat. A first reset sensor 8 is disposed near the radar 12, a second reset sensor 9 is disposed near the control plate 6, and the second reset sensor 9 and the first reset sensor 8 are disposed in a bilateral symmetry manner. The control seat is further provided with a first photoelectric sensor 10 and a second photoelectric sensor 11, and the first photoelectric sensor 10 and the second photoelectric sensor 11 are disposed on the front side of the chassis of the machine body 5 in the downstairs direction and configured to irradiate downwards. The first reset sensor 8 and the second reset sensor 9, as well as a first omni-directional wheel 39 and a second omni-directional wheel 42 which are described below are distributed on two sides of the machine body, forming two void-detecting structures. Void-detecting here refers to the downward detection of voids (absence of a surface to step on). Through signals detected by the two infrared photoelectric sensors and the void-detecting structures, the control system determines whether the machine body extends out of the tread surface of the stair step to prevent falling. The radar 12 detects whether there is an obstacle in the forward direction, such as a wall or a railing all the time, and obtains the position of the robot on the step.

Figure 3:
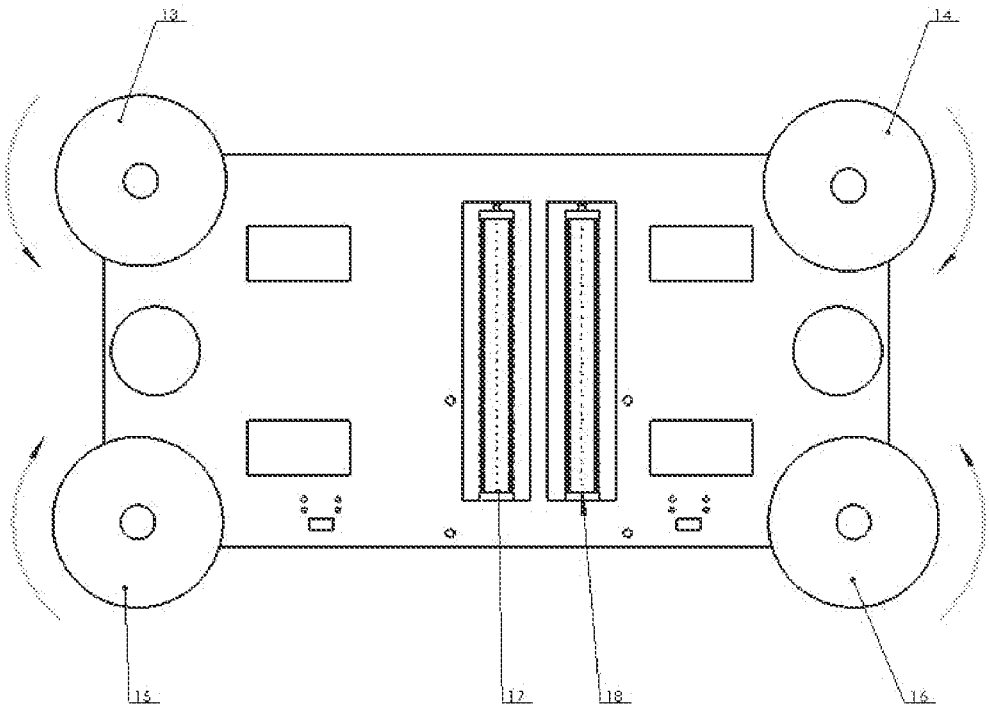
FIG. 3 is a bottom view of a cleaning mechanism according to the present invention.
Figure 4:
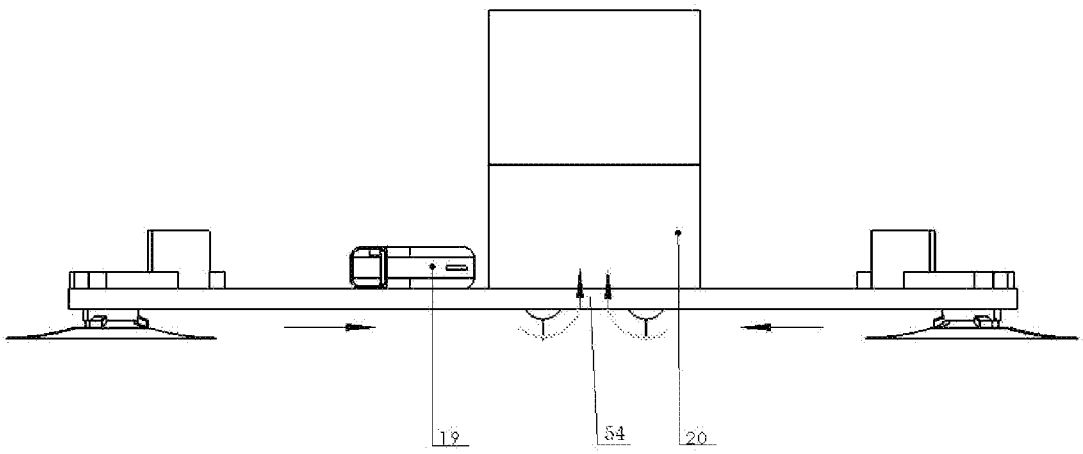
FIG. 4 is a front view of a cleaning mechanism according to the present invention.

Specifically, referring to FIGS. 3-4, the cleaning mechanism 2 includes a first rotating brush 13, a second rotating brush 14, a third rotating brush 15 and a fourth rotating brush 16 which are driven by a motor, and a first rolling brush 17 and a second rolling brush 18 which are driven by a motor. The first rotating brush 13 and the third rotating brush 15 are distributed on the left side of the machine body 5 and perform symmetric rotation movement, the second rotating brush 14 and the fourth rotating brush 16 are distributed on the right side of the machine body 5 and perform symmetric rotation movement, and the first rolling brush 17 and the second rolling brush 18 are distributed in the middle of the machine body 5 and perform symmetric rotation movement. The cleaning mechanism 2 further includes a fan 19 and a dust box 20 which are disposed on the inner side of the machine body 5. The fan 19 is connected to the dust box 20, and the interface between the fan 19 and the dust box 20 is in a sealed connection. A dust inlet 54 is formed between the first rolling brush 17 and the second rolling brush 18.

In actual use, the first rotating brush 13, the second rotating brush 14, the third rotating brush 15 and the fourth rotating brush 16 are configured to clean garbage and sweep the garbage towards the dust inlet 54 between the first rolling brush 17 and the second rolling brush 18. Negative pressure is formed at the dust inlet 54 under the action of the fan 19 for sucking the cleaned garbage into the dust box 20, so that the cleaning function is realized.

Figure 7:
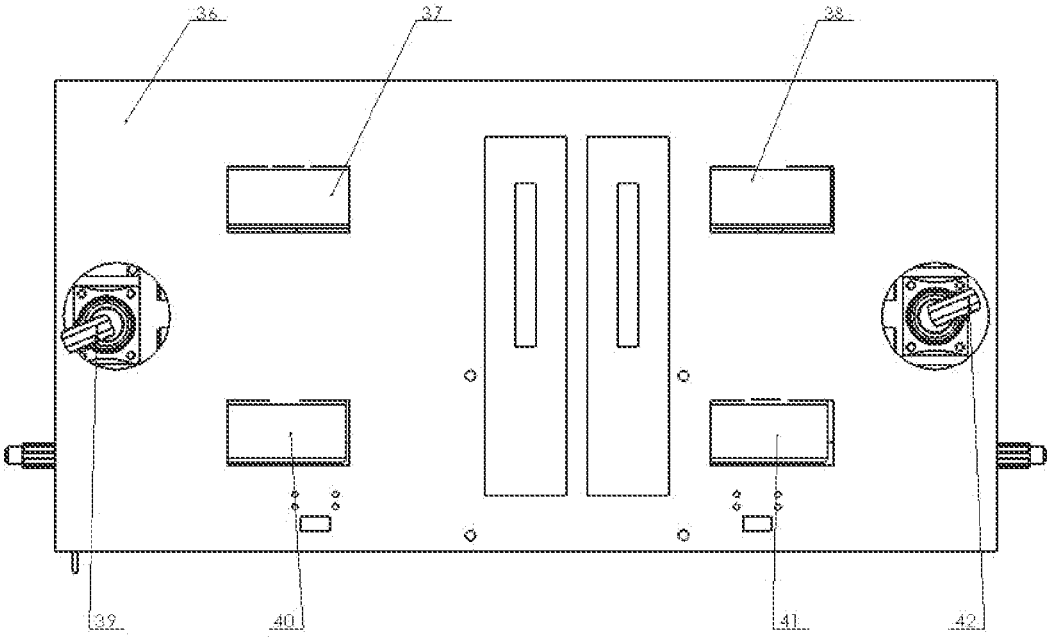
FIG. 7 is a bottom view of a machine body according to the present invention.
Figure 8:
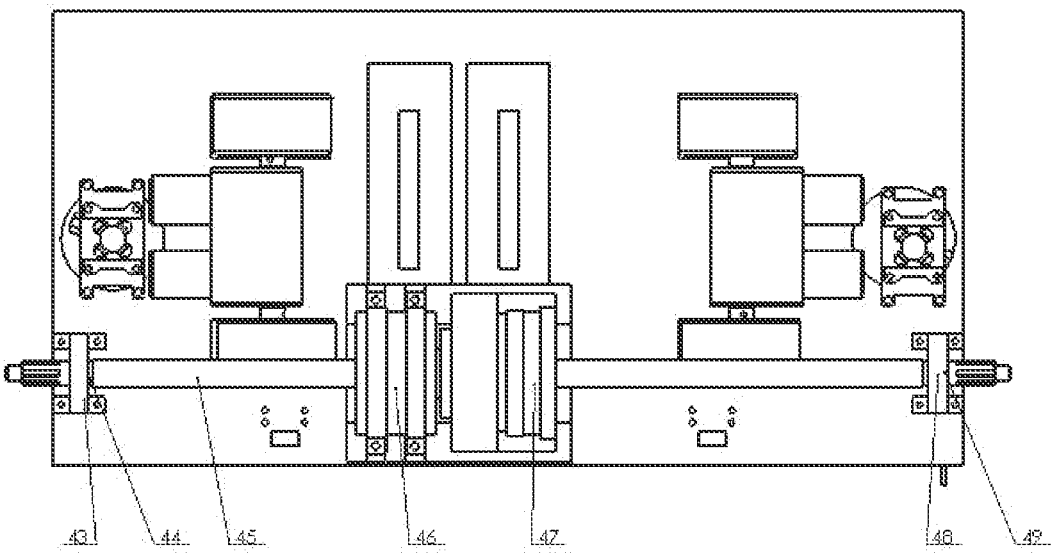
FIG. 8 is a top view of a machine body according to the present invention.
Figure 9:
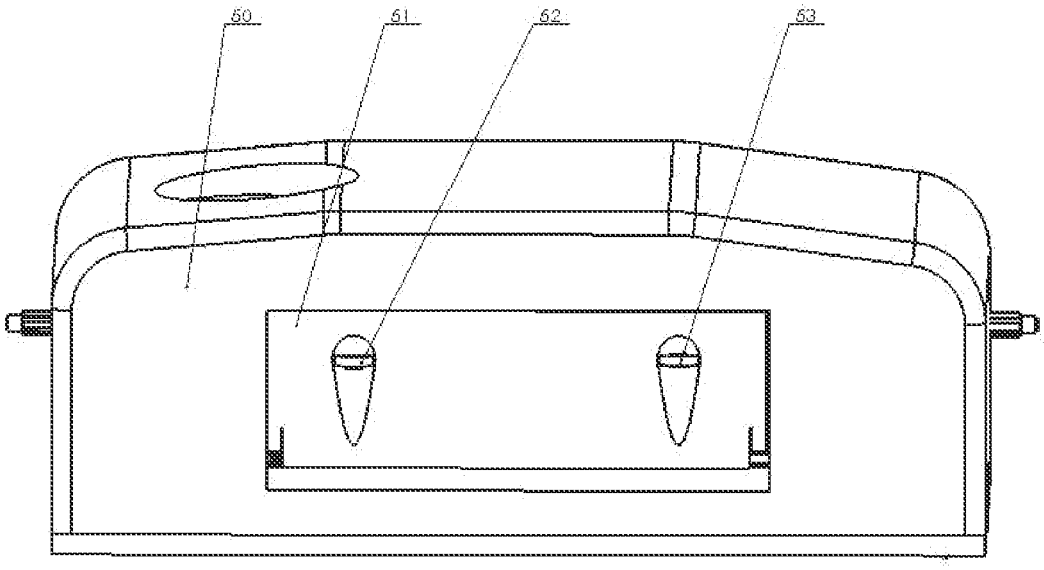
FIG. 9 is a front view of a machine body according to the present invention.

Specifically, referring to FIGS. 7-9, the machine body 5 includes a housing 50 and a bottom plate 36 disposed at the bottom of the housing 50. The bottom plate 36 is provided with a first main driving wheel 37, a second main driving wheel 38, a third main driving wheel 40, a fourth main driving wheel 41, a first omni-directional wheel 39 and a second omni-directional wheel 42; the first main driving wheel 37, the third main driving wheel 40 and the first omni-directional wheel 39 are distributed on the left side part of the machine body 5, and the second main driving wheel 38, the fourth main driving wheel 41 and the second omni-directional wheel 42 are distributed on the right side part of the machine body 5.

A rotating main shaft 45 which is transversely arranged is disposed on the inner part of the machine body 5, a rotational arm motor 46 and a speed reducer 47 are disposed in the middle of the rotating main shaft 45, a first shaft end support 43 and a first bearing 44 are disposed at one end of the rotating main shaft 45, and a second shaft end support 48 and a second bearing 49 are disposed at the other end of the rotating main shaft 45. The rotating main shaft 45 is perpendicular to the axial directions of the first main driving wheel 37, the second main driving wheel 38, the third main driving wheel 40 and the fourth main driving wheel 41. The first shaft end support 43 and the second shaft end support 48 are both fixedly connected to the bottom plate 36, the first shaft end fixing seat 43 is connected through the first bearing 44 to allow relative rotation, and the second shaft end support 48 is connected through the second bearing 49 to allow relative rotation.

The housing 50 is provided with a housing baffle 51, the inner side of the housing baffle 51 is provided with a first roller 52 and a second roller 53, and the first roller 52 and the second roller 53 are installed on the house baffle through the connecting pieces respectively to allow rotation.

The first main driving wheel 37, the second main driving wheel 38, the third main driving wheel 40 and the fourth main driving wheel 41 are all Mecanum wheels.

In the embodiment, the rotating main shaft 45 is perpendicular to the axial directions of the first main driving wheel 37, the second main driving wheel 38, the third main driving wheel 40 and the fourth main driving wheel 41, so that the robot does not need to turning its body to go downstairs or upstairs. After going downstairs or upstairs, as the main driving wheels of the robot move along the tread surface (namely, in the left-right direction of the main driving wheel shafts perpendicular to the tread surface), the robot can directly clean stairs in the left-right direction under the driving of the main driving wheels, and the robot does not need to turning its body. It should be noted herein that the term "turning its body" means that the robot is rotated 90 degrees in situ about the vertical central axis of the robot.

Figure 5:
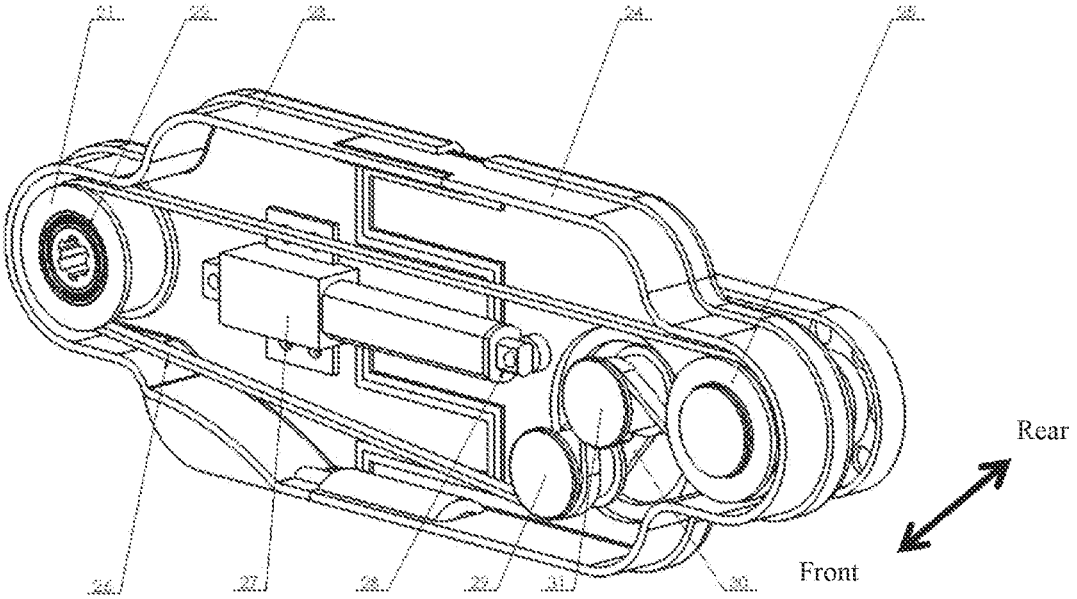
FIG. 5 is a structural schematic diagram illustrating a side-front view of a first retractable rotational arm mechanism according to the present invention.
Figure 6:
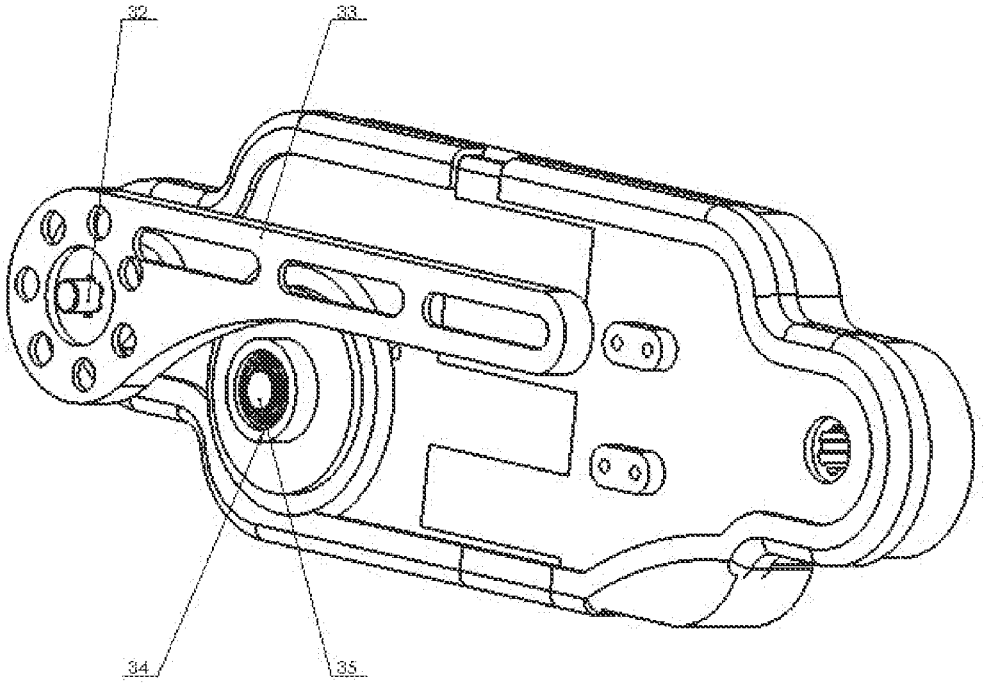
FIG. 6 is a structural schematic diagram illustrating a side-rear view of a first retractable rotational arm mechanism according to the present invention.

Specifically, referring to FIGS. 5-6, the first retractable rotational arm mechanism 3 and the second retractable rotational arm mechanism 4 have the same structure, and are both fixedly connected to the rotating main shaft through the two ends of the rotating main shaft; the first retractable rotational arm mechanism 3 includes a driving large arm 23 connected to the rotating main shaft 45 and a driven large arm 24 connected to the driving large arm 23. A driving pulley 21, a third bearing 22 and a push rod seat 27 are disposed on the inner side wall of the driving large arm 23, the first shaft end support 43 and the driving pulley 21 are fixedly connected through a screw, and the driving pulley 21 is connected to the rotating main shaft 45 through the third bearing 22 to allow mutual rotation. A driven pulley 25, a tensioning wheel rotational arm 30 and a push rod part 28 are disposed on the inner side wall of the driven large arm 23, one end of the push rod part 28 is connected to the driven large arm 24, and the other end of the push rod part 28 is connected to the push rod seat 27.

A first tensioning wheel 29 and a second tensioning wheel 31 are disposed on the tensioning wheel rotational arm 30, and the driving pulley 21, the first tensioning wheel 29, the second tensioning wheel 31 and the driven pulley 25 are sleeved with a drive belt 26.

The tensioning wheel rotational arm 30 is fixedly connected to a tensioning wheel rotating shaft 35, and the tensioning wheel rotating shaft 35 and the driven large arm 24 are connected through the fourth bearing and torsion spring 34 to allow relative rotation. The driven pulley 25 is connected to a rotating small arm 33 through a rotating shaft 32, and the rotating small arm 33 is disposed on the outer side of the driven large arm 24, allowing mutual rotation with the driven large arm 24.

Figure 10:
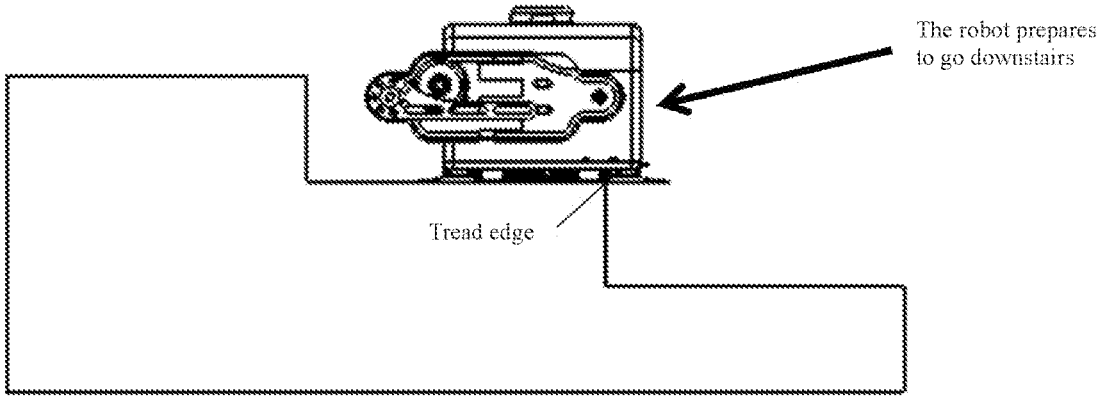
FIGS. 10-15 are schematic diagrams of states of a working principle according to the present invention.
Figure 11:
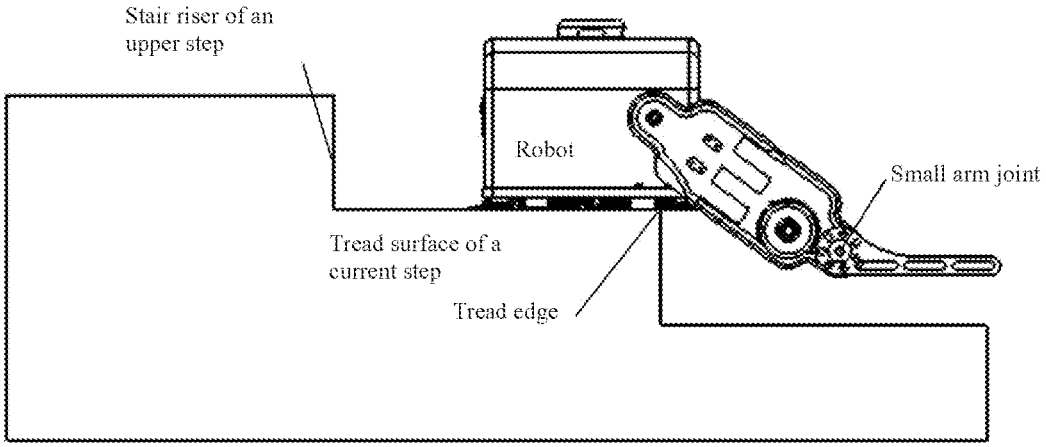
Figure 12:
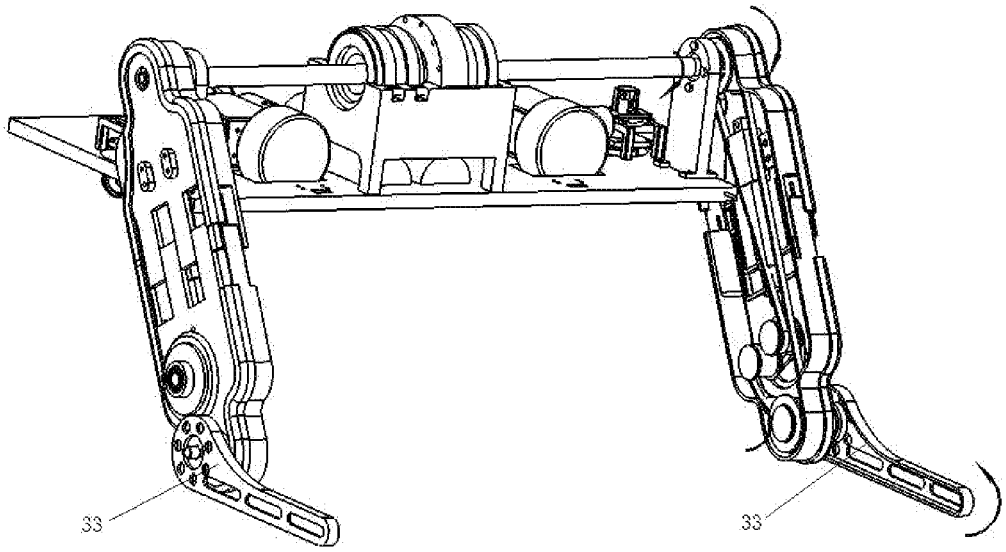

The working principle of the present invention is as follows: Before the robot is ready to go downstairs, it utilizes the principle of relying on paired main driving wheels (Mecanum wheels) rotating reversely to make the machine body of the robot move laterally (the robot normally moves leftwards and rightwards along the tread surface to clean, and at the moment, the Mecanum wheels are used as general wheels to rotate in the same direction; and when the robot is ready to go downstairs, the paired Mecanum wheels rotate reversely, so that the robot can extend forwards to prepare for going downstairs), so that the robot can slightly extend out from the stair riser. As shown in FIG. 10, it is a schematic diagram in which the machine body of the robot slightly extends to prepare for going downstairs. Then the rotating main shaft 45 rotates clockwise to drive the rotating large arm 23 to rotate clockwise, the driving large arm 23 rotates relative to the first shaft end support 43 and the driving pulley 21. When the driving large arm is rotating clockwise, it is equivalent that the driving pulley 21 rotates counterclockwise relative to the driving large arm 23 and thus drives the drive belt 26, the drive belt 26 drives the driven pulley 25 to rotate counterclockwise, the driven pulley 25 drives the rotating shaft 32 to rotate counterclockwise, and the rotating shaft 32 drives the rotating small arm 33 to rotate counterclockwise, so that the whole rotational arm mechanism is unfolded as shown in FIG. 11. In the rotating process, when the rotating small arm 33 is in contact with the surface of the next step, the rotating small arm 33 serves as a supporting arm and is relatively static with the stair. The rotational arm continues to move according to the above-mentioned movement relation, and the rotational arm drives the machine body 5 to do circular motion by taking the small arm joint as the center to leave the current step surface until the machine body 5 is in contact with the surface of the next step. In the whole process, the machine body does circular motion, but does not rotate on its own; it still undergoes a translation motion, so a circular translation motion is realized. As shown in FIG. 12, it is a working principle diagram of the first retractable rotational arm mechanism.

Figure 13:
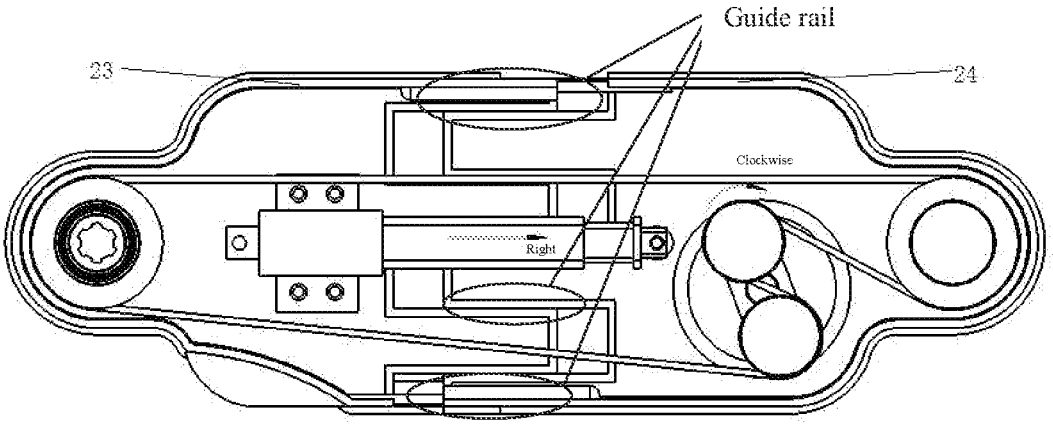

FIG. 13 is a schematic diagram of a working principle of a retractable rotational arm, and in order to adapt to stairs of different heights, the rotational arm designed according to the present invention is retractable. If the rotational arm is extended, the motor drives the push rod part 28 to move rightwards. Thrust of the push rod part 28 makes a tensioning device (the tensioning wheel rotational arm 30, the first tensioning wheel 29 and the second tensioning wheel 31) rotate clockwise against the counterclockwise torque of the torsion spring 34, the driving large arm 23 and the driven large arm 24 are separated from each other along guide rails, and the entire length of the rotational arm is increased. If the rotational arm is retracted, after the above-mentioned extension, the motor reversely rotates to retract the push rod part. The driven large arm 24 are retracted by the driving large arm 23 along the guide rails, the entire length of the rotational arm is shortened, and the retraction motion can be completed by the retraction force of the push rod part and the reset torque force of the torsion spring 34 of the tensioning device.

Figure 14:
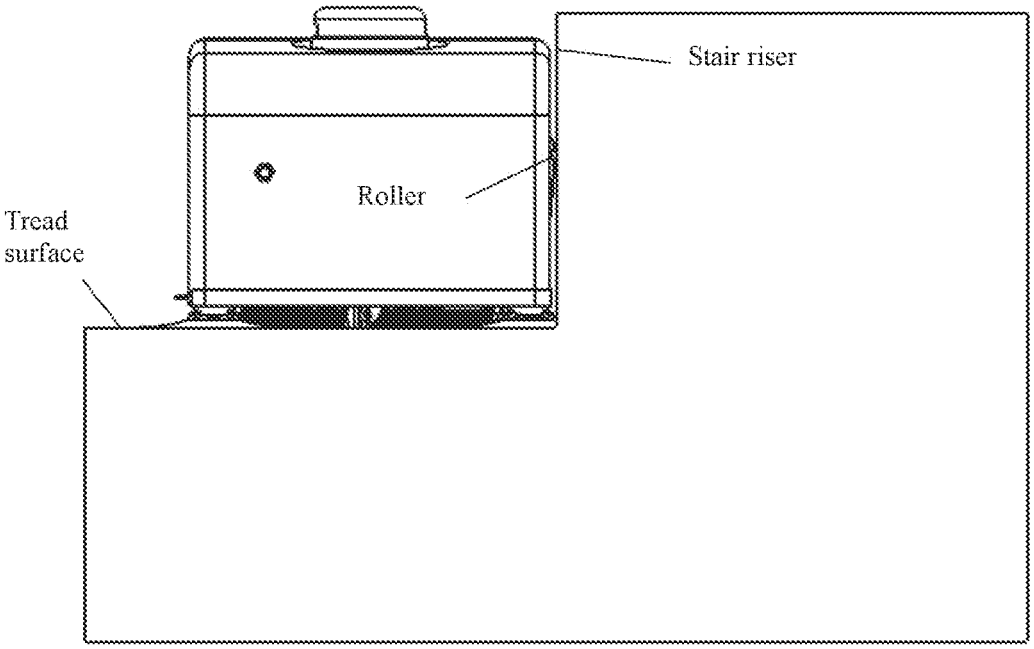

FIG. 14 is a schematic diagram of a working principle in which the robot moves along the tread surface against the stair riser. To make the robot move along the tread surface against the stair riser, a design with rear-mounted rollers is used to keep the first roller 52 and the second roller 53 in contact with and rolling along the stair riser. Since the rear part of the robot is tightly attached to the stair riser, at this moment, if the rotational arm is in the posture shown in FIG. 1, the rotational arm will interfere with the stair riser. Therefore, the rotational arm needs to be slightly lifted (namely, rotated by a certain angle) in control to make the rotational arm not collide with the stair riser. In control of the robot movement, it is also necessary to make the outer Mecanum wheels (i.e., the third main driving wheel 40 and the fourth main driving wheel 41) rotate at a slightly higher speed than the inner Mecanum wheels (i.e., the first main driving wheel 37, and the second main driving wheel 38), ensuring that the robot is always attached to the stair riser rather than moving away from the stair riser. Making the robot attached to the stair riser has the advantage: Sweeping brushes, namely the first rotating brush 13 and the second rotating brush 14, are tightly attached to the joint parts of the stair riser and the tread surface, so that the parts can be cleaned completely.

Figure 15:
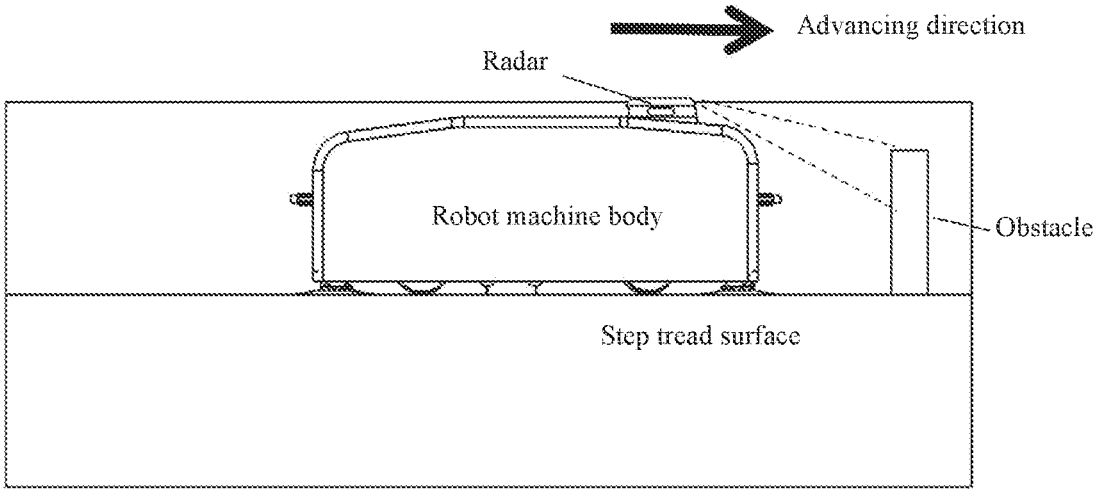

FIG. 15 is a schematic diagram of a working principle of radar detection. The radar 12 is mainly responsible for detecting obstacles in the front, left and right, and detecting whether there is a stair in the front. According to the radar detection, the robot decides whether to go downstairs, stop moving or retreat according to the method for discerning obstacles and stairs and the related control method.

In addition, it should be noted that, the motor for driving the main driving wheels and the brushes is not essentially different from the prior art, and since the motor is not the key protective technical solution of the present invention, the structure and the working principle of the motor are not elaborated herein.

The description and practice disclosed in the present invention will be readily appreciated and understandable by those of ordinary skill in the art, and various modifications and adaptations may be made without departing from the principles of the present invention. Therefore, modifications and improvements made without departing from the spirit of the present invention should also be considered as the protection scope of the present invention.

The invention claimed is:

1. A stair cleaning robot based on retractable rotational arms, comprising:

a cleaning robot body, wherein the cleaning robot body comprises a machine body, a control system disposed at a top of the machine body and a cleaning mechanism disposed at a bottom of the machine body;

a first retractable rotational arm mechanism is disposed on a left side of the machine body, a second retractable rotational arm mechanism is disposed on a right side of the machine body, and the first retractable rotational arm mechanism and the second retractable rotational arm mechanism are disposed in a bilateral symmetry manner;

the control system comprises a control plate, a battery and a radar which are disposed on a control seat; a first reset sensor is disposed near the radar, a second reset sensor is disposed near the control plate, and the second reset sensor and the first reset sensor are disposed in a bilateral symmetry manner; and the control seat is further provided with a first photoelectric sensor and a second photoelectric sensor, and the first photoelectric sensor and the second photoelectric sensor are disposed on the front side of a bottom plate of the machine body.

2. The stair cleaning robot based on retractable rotational arms according to claim 1, wherein the machine body comprises a housing and a bottom plate disposed at a bottom of the housing;

the bottom plate is provided with a first main driving wheel, a second main driving wheel, a third main driving wheel, a fourth main driving wheel, a first omni-directional wheel and a second omni-directional wheel;

the first main driving wheel, the third main driving wheel and the first omni-directional wheel are distributed on a left side part of the machine body, and the second main driving wheel, the fourth main driving wheel and the second omni-directional wheel are distributed on a right side part of the machine body;

a rotating main shaft which is transversely arranged is disposed on an inner part of the machine body, a rotational arm motor and a speed reducer are disposed in a middle of the rotating main shaft, a first shaft end support and a first bearing are disposed at one end of the rotating main shaft, and a second shaft end support and a second bearing are disposed at the other end of the rotating main shaft;

the rotating main shaft is perpendicular to axial directions of the first main driving wheel, the second main driving wheel, the third main driving wheel and the fourth main driving wheel; the first shaft end support and the second shaft end support are both fixedly connected to the bottom plate, the first shaft end support is connected through the first bearing to allow relative rotation, and the second shaft end support is connected through the second bearing to allow relative rotation; and the housing is provided with a housing baffle, an inner side of the housing baffle is provided with a first roller and a second roller, and the first roller and the second roller are installed on the house baffle through connecting pieces respectively to allow rotation.

3. The stair cleaning robot based on retractable rotational arms according to claim 2, wherein the first retractable rotational arm mechanism and the second retractable rotational arm mechanism have a same structure and are both fixedly connected to the rotating main shaft through the two ends of the rotating main shaft;

the first retractable rotational arm mechanism comprises a driving large arm connected to the rotating main shaft and a driven large arm connected to the driving large arm;

a driving pulley, a third bearing and a push rod seat are disposed on an inner side wall of the driving large arm, the first shaft end support and the driving pulley are fixedly connected through a screw, and the driving pulley is connected to the rotating main shaft through the third bearing to allow relative rotation; a driven pulley, a tensioning wheel rotational arm and a push rod part are disposed on an inner side wall of the driven large arm, one end of the push rod part is connected to the driven large arm, and the other end of the push rod part is connected to the push rod seat; and a first tensioning wheel and a second tensioning wheel are disposed on the tensioning wheel rotational arm, and the driving pulley, the first tensioning wheel, the second tensioning wheel and the driven pulley are sleeved with a drive belt.

4. The stair cleaning robot based on retractable rotational arms according to claim 3, wherein the tensioning wheel rotational arm is fixedly connected to a tensioning wheel rotating shaft, and the tensioning wheel rotating shaft and the driven large arm are connected through a fourth bearing and torsion spring to allow relative rotation; the driven pulley is connected to a rotating small arm through a rotating shaft, and the rotating small arm is disposed on an outer side of the driven large arm, allowing relative rotation with the driven large arm.

5. The stair cleaning robot based on retractable rotational arms according to claim 2, wherein the first main driving wheel, the second main driving wheel, the third main driving wheel and the fourth main driving wheel are all Mecanum wheels.

6. The stair cleaning robot based on retractable rotational arms according to claim 1, wherein the cleaning mechanism comprises a first rotating brush, a second rotating brush, a third rotating brush and a fourth rotating brush which are driven by a motor, and a first rolling brush and a second rolling brush which are driven by a motor;

the first rotating brush and the third rotating brush are distributed on the left side of the machine body and perform symmetric rotation movement, the second rotating brush and the fourth rotating brush are distributed on the right side of the machine body and perform symmetric rotation movement, and the first rolling brush and the second rolling brush are distributed in a middle of the machine body and perform symmetric rotation movement; and the cleaning mechanism further comprises a fan and a dust box which are disposed on an inner side of the machine body; the fan is connected to the dust box, a dust inlet is formed between the first rolling brush and the second rolling brush, and the fan forms negative pressure at the dust inlet to suck garbage into the dust box.

* * * * *